United States Patent [19]

Baehler et al.

[11] Patent Number: 4,743,776

[45] Date of Patent: May 10, 1988

[54] STARTER-GENERATOR FOR ENGINES

[75] Inventors: Thomas Baehler; Victor Benson; Wayne Flygare, all of Rockford, Ill.

[73] Assignee: Sundstrand Corporation, Rockford, Ill.

[21] Appl. No.: 902,598

[22] Filed: Sep. 2, 1986

[51] Int. Cl.[4] ..... F02N 11/04

[52] U.S. Cl. ..... 290/31; 290/22; 290/46

[58] Field of Search ..... 74/687; 290/10, 22, 290/27, 31, 46; 322/9, 10

[56] References Cited

U.S. PATENT DOCUMENTS

| | | | |
|---|---|---|---|
| 3,264,482 | 8/1966 | Clark et al. | 290/38 |
| 3,274,855 | 9/1966 | Reynolds et al. | 74/687 |
| 3,576,143 | 4/1971 | Baits | 74/687 |
| 3,617,762 | 11/1971 | Price et al. | 290/46 |
| 4,074,180 | 2/1978 | Sharpe et al. | 322/29 |
| 4,252,335 | 2/1981 | Cordner et al. | 74/687 |
| 4,278,928 | 7/1981 | Griffiths et al. | 322/29 |
| 4,315,442 | 2/1982 | Cordner | 74/687 |
| 4,330,743 | 5/1982 | Glennon | 290/46 X |
| 4,456,830 | 6/1984 | Cronin | 290/27 |
| 4,473,752 | 9/1984 | Cronin | 290/38 R |
| 4,481,459 | 11/1984 | Mehl et al. | 290/46 X |

*Primary Examiner*—William M. Shoop, Jr.
*Assistant Examiner*—W. E. Duncanson, Jr.
*Attorney, Agent, or Firm*—Wood, Dalton, Phillips, Mason & Rowe

[57] ABSTRACT

Inefficiencies in electrical starter-generator systems for turbine engines are avoided in a construction including a dynamoelectric machine 16 operable as a motor or as a generator and having a rotor 26, a hydraulic torque converter 70 including an impeller 80 connected to the rotor 26 and a turbine 86. A system 94, 96 is provided for selectively providing hydraulic fluid to the torque converter 70 and a constant speed drive 112, 142, 144 is included. Overrunning clutches 108 and 158 interconnect the turbine 86 and an input for the constant speed drive for allowing the input to overrun the turbine 86 but not the reverse, and for interconnecting the rotor 26 and an output 130 of the constant speed drive for allowing the rotor 26 to overrun the output 130.

11 Claims, 2 Drawing Sheets

STARTER-GENERATOR FOR ENGINES

FIELD OF THE INVENTION

This invention relates to engine starting and power generation systems, particularly for turbine engines such as those employed on aircraft.

BACKGROUND OF THE INVENTION

Many turbine engines employed in aircraft at the present time are cranked for starting through the use of the application of compressed air to an accessory air turbine motor which drives the turbine. The compressed air is variously provided by an auxiliary power unit or from a ground cart or the like.

Unfortunately, the presence of such a starting system requires numerous air ducts, seals and air valves which are not only bulky, and thus difficult to include in a streamlined aircraft configuration to minimize drag, they frequently are heavy as well and thereby reduce the payload carrying capability of the aircraft.

Consequently, consideration has been given to electric starting of turbine engines. As the aircraft typically already include electrical systems and wiring, incorporating an electric starting capability does not appreciable add to the electrical system since it can make use of already existing components and wiring.

Most desirably, a single dynamoelectric machine that is alternatively operable as a generator or as a starter is employed to eliminate the need for separate machines, one for starting and one for power generation. Heretofore, system components employed in operation of the dynamoelectric machine in the starting mode have remained coupled in the system during power generation and vice versa. Particularly during power generation, this results in a decrease in operational efficiency.

The present invention is directed to overcoming the above problems.

SUMMARY OF THE INVENTION

It is the principal object of the invention to provide a new and improved starter-generator for turbine engines. More particularly, it is an object of the invention to provide a starter-generator system for turbine engines wherein components unique to engine starting functions are effectively dropped out of the system during power generation to maximize system efficienty.

An exemplary embodiment achieves the foregoing object in a starter-generator system including a dynamoelectric machine alternatively operable as a motor or as a generator and which has a rotor. A hydraulic torque converter includes a housing containing an impeller and a turbine. The impeller is connected to the rotor to be driven thereby when the dynamoelectric machine is operated as a motor. Means are provided for selectively filling the housing with hydraulic fluid to couple the impeller and the turbine. A controlled speed drive unit has an input adapted to be connected to a turbine engine, an output adapted to be connected to the rotor, and a control means interconnecting the input and the output to provide a desired speed relation between the two. The system includes a first coupling interconnecting the turbine and the input which is operable to disconnect the input from the turbine for input speeds greater than the speed of the turbine and a second coupling interconnecting the rotor and the output and operable to disconnect the rotor from the output for rotor speeds greater than the speed of the output.

As a consequence of the foregoing construction, a turbine engine (a) may be started by the dynamoelectric machine when operated as a motor via a power train including the torque converter and the first coupling, and (b) may drive the dynamoelectric machine as a generator at a desired speed via a second power train including the controlled speed drive and the second coupling.

Thus, system components unique to power generation and/or starting are decoupled from the system when the system is operating in the other mode.

In a highly preferred embodiment, both of the couplings are in the form of overrunning clutches.

In order to provide an optimal configuration for use in an aircraft, the invention contemplates that the torque converter and the rotor be coaxial, although in other environments, the converter can be disposed at other locations in the system.

The invention also contemplates that the selective filling means comprise an inlet to the housing, a pump connected to the housing inlet, and a means for controlling the flow from the pump to the inlet. In a highly preferred embodiment, the flow controlling means comprises a valve interposed between the pump and the housing.

The invention further contemplates that the housing for the torque converter include an open outlet with the pump being sized to deliver more hydraulic fluid to the inlet than can escape the housing through the open outlet in the same period of time.

Preferably, the dynamoelectric machine is a so-called "brushless" generator which is alternatively operable as both an A.C. synchronous motor and a squirrel cage induction motor and the rotor of the same includes a rectifier and a field. A speed responsive switch is carried by the rotor for shunting the rectifier and the field at rotor speeds less a desired level so as to initially cause operation as an A.C. squirrel cage motor for turbine starting purposes. Once the desired speed level is attained, the switch opens and the machine continues to function, but as an A.C. synchronous motor, until the engine is started.

Other objects and advantages will become apparent from the following specification taken in connection with the accompanying drawings.

DESCRIPTION OF THE PREFERRED EMBODIMENT

Figure 1A:
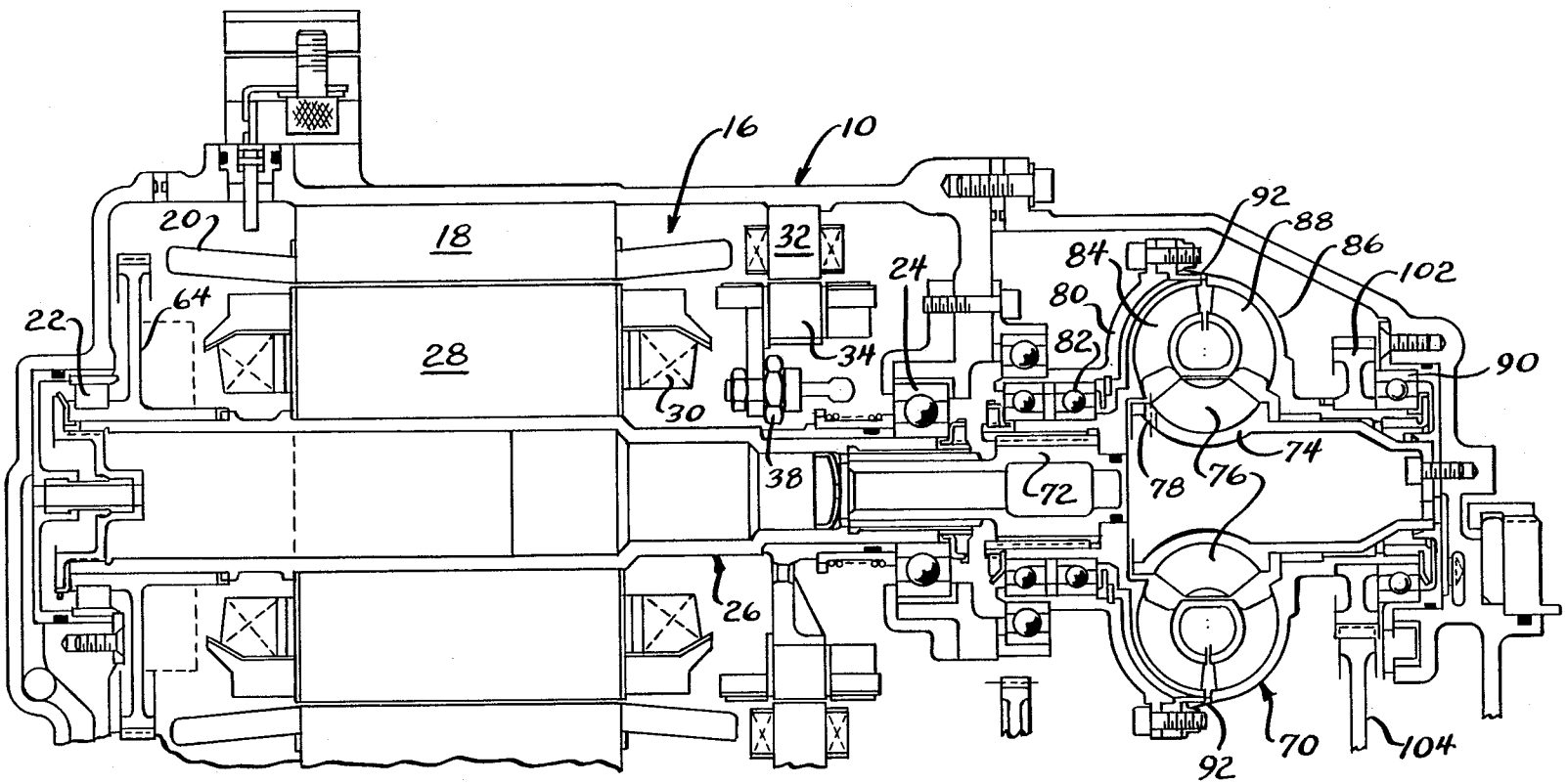
FIG. 1 is a sectional view of a starter-generator made according to the invention with certain components shown schematically and made up of FIGS. 1*a* and 1*b*, the latter to be located below the former.

An exemplary embodiment of a starter-generator made according to the invention is illustrated in FIG. 1 and is seen to include a housing, generally designated 10. Extending from one end of the housing is a splined shaft 12 adapted to be connected to a turbine engine 14 for the purposes of (a) driving the engine 14 to start the same, and (b) being driven by the engine 14 for power generation purposes.

Contained within the housing 10 is a dynamoelectric machine in the form of a so called "brushless" generator, generally designated 16. The generator 16 includes a stator 18 having windings 20 in which electrical power is induced, usually a three phase, 400 hertz, during electrical generation. The windings 20 also receive current from another source when the machine 16 is utilized as a starter.

Journaled as by bearings 22 and 24 within the stator 18 is a rotor, generally designated 26. The rotor 26 includes a body 28 of ferromagnetic material and is provided with a field winding 30. As is well known, when the machine 16 is being utilized as a generator, a direct current will be flowed through the winding 30 to provide a magnetic field for induction of current in the windings 20.

Figures 1B, 2:
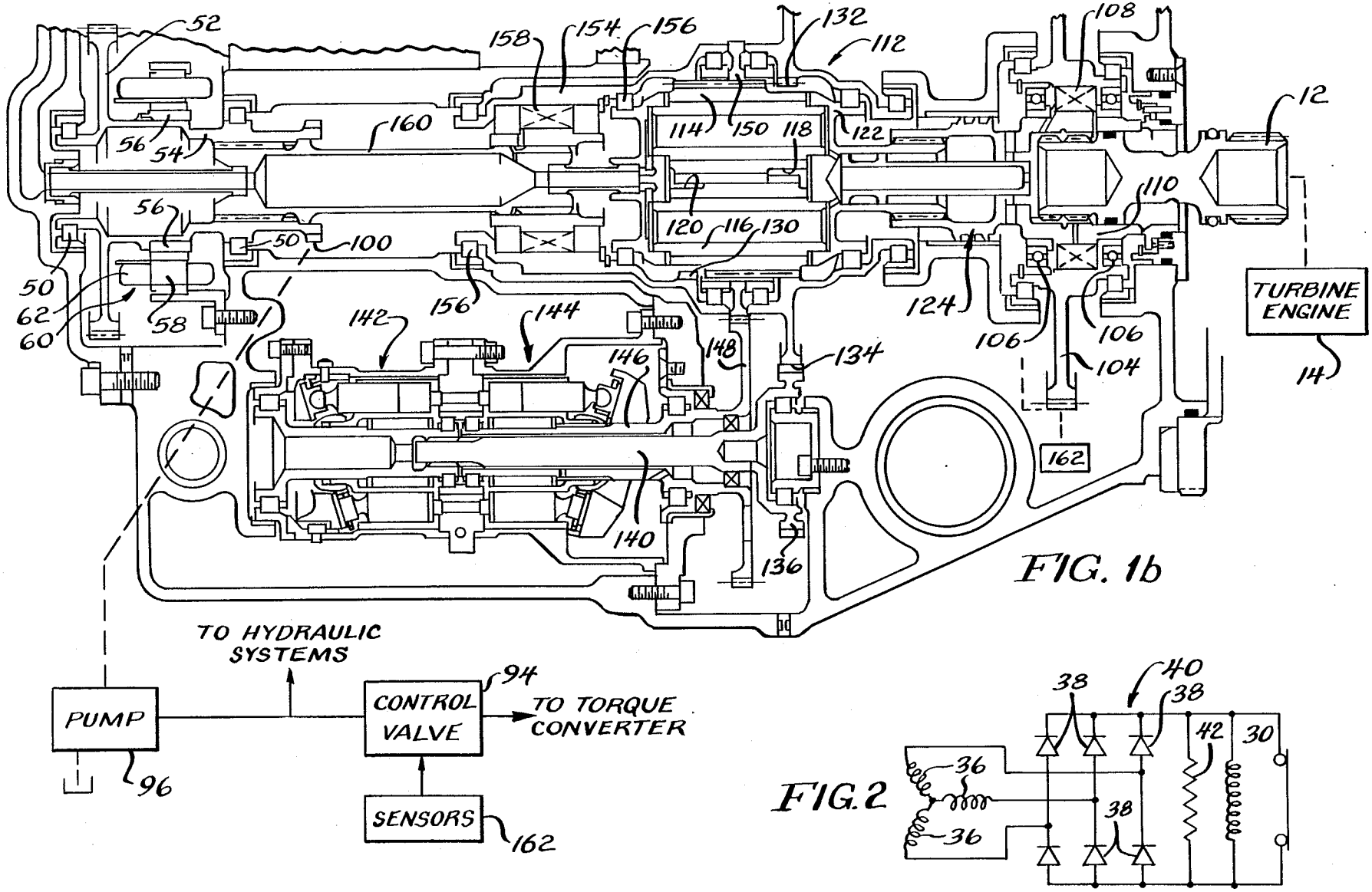
FIG. 2 an electrical schematic of the rotor of the dynamoelectric machine used in the system.

The machine also includes an exciter stator 32 mounted to the housing 10 and an exciter rotor section 34 carried by and rotatable with the rotor 26. As best seen in FIG. 2, the exciter rotor section 34 includes three phase windings 36 connected to a series of diodes 38 connected in the manner illustrated in FIG. 2 to form a full wave rectifier, generally designated 40. As is well known, the rectifier 40 rectifies three phase alternating current induced in the exciter rotor section 34 to provide a direct current to the field winding 30 of the main generator.

FIG. 2 also shows the presence of a resistor 42 connected across the rectifier 40 for the conventional purpose of shunting transient spikes.

Electrically, the rotor 26 is completed by the presence of a centrifugal switch 44 which is connected in shunt relation across both the rectifier 40 and the field 30. The switch 40 is, of course, carried by the rotor and is operable to open only when speeds approximating those utilized during power generation have been attained by the rotor 26. Where the machine 16 is, for example, a four pole machine, a typical operating speed for aircraft use would be 12,000 rpm. The switch 44 would be configured to open at a speed somewhat less than that speed but sufficiently high that the turbine 14 would be at a self sustaining speed during the starting mode.

With the switch 44 closed, the passing of electrical power to the windings 20 from an exterior source will cause the machine 16 to operate first as an A.C. squirrel cage induction motor and thus provide the desired driving force to crank the turbine 14. Conversely, when the turbine 14 has very nearly reached speed sufficient to be self sustaining in its operation, the switch 44 will open at a predetermined speed under the influence of centrifugal force. The machine 16 will now operate as an A.C. synchronous motor and continue to crank the turbine until the turbine is self-sustaining, i.e.,: the turbine has started. Power to the windings 20 can then be removed. At this time, induced power may be taken from the windings 20.

Turning to FIG. 1*b*, coaxial with the shaft 12 but at the opposite side of the housing 10, bearings 50 journal a gear 52. The hub 54 of the gear 52 mounts a plurality of permanent magnets 56 rotatable within a permanent magnet generator stator 58 secured to the housing. As a consequence, a permanent magnet generator (PMG), generally designated 60, is defined and the same is operative to power the exciter stator 32 in a conventional fashion. In addition, voltage levels in a winding 62 associated with the stator 58 of the permanent magnet generator 60 may be utilized for control purposes as being indicative of system speed.

The gear 52 is meshed with a similar gear 64 (FIG. 1*a*) coupled to the rotor 26 at the left hand end thereof as seen in the drawings. Thus, the speed of the PMG 60 will always be proportional to the rotational rate of the rotor 26.

The end of the rotor 26 remote from the gear 64 is coupled to a conventional torque converter, generally designated 70, by a spline coupling 72.

The torque converter 70 includes a stator element 74 mounted secured to the main housing 10 by any suitable means. The stator 74 includes conventionally configured stator blades 76 and at least one hydraulic fluid inlet port 78.

A conventional impeller 80 is mounted on the coupling 72 to be driven thereby and is journaled by means of bearings 82. The impeller 80 has impeller blades 84, also of conventional configuration.

The torque converter 70 is basically completed by a turbine 86 having turbine blades 88 of conventional configuration and journaled by means of bearings 90 to the housing 10. A small gap 92 at the radially outer part of the interface between the impeller 80 and the turbine 86 serves as an outlet from the torque converter 70 for hydraulic fluid.

The inlet 78 is connected via a control valve 94 to a hydraulic pump 96 which provides hydraulic fluid under pressure to various hydraulic systems within the apparatus. The pump 96 may be driven, as shown schematically, by connection to gear teeth 100 on the hub 54 of the gear 52.

It is to be particularly noted that the inlet 78 and the pump 96 are sized so that when the valve 94 is open, more hydraulic fluid can be provided to the interior of the torque converter 70 in a given unit of time than can exit the outlet 92. As a consequence of this arrangement, whenever the impeller 80 is being driven and the valve 94 is open, the interior of the torque converter 70 will be filled with hydraulic fluid and the turbine 86 will be driven thereby. Conversely, when the valve 94 is closed, hydraulic fluid within the torque converter 70 will readily exit the same via the outlet 92 under the influence of centrifugal force to thereby decouple the turbine 86 from the impeller 80.

A gear 102 is coupled to the turbine 86 and is meshed with a gear 104, the latter being journaled by a bearing 106 for rotation about an axis coaxial with the shaft 12. In actuality, an overrunning clutch 108 serves to couple the gear 104 to a hub 110 to which the shaft 12 is internally splined.

The overrunning clutch 108 is such that when, after various gear ratios are considered, the speed of the turbine 88 of the torque converter 70 is greater than the speed of the shaft 12, the latter will be driven by the former through the overrunning clutch 108. Conversely, should the speed of the shaft 12 exceed that of the gear 104 the shaft 12 can freely overrun the turbine 86, thereby effectively decoupling the torque converter 70 from the system.

The system includes a conventional differential, generally designated 112 as part of a constant speed drive which is coaxial with the shaft 12. The differential 112 includes first and second, meshed gears 114 and 116 which are meshed at their center portions and include respective reliefs 118 and 120 adjacent their right and left hand ends, respectively as viewed in FIG. 1b. The gears 114 and 116 are journaled for rotation about their respective axes as well as revolution about the axis defined by the shaft 12 by a carrier 122 coupled via a conventional jaw type or thermal disconnect coupling, generally designated 124 to the hub 110. Thus rotation of the shaft 12, whether via the overrunning clutch 108, or as a result of operation of the engine 14, will result in rotation and revolution of the gears 114 and 116.

The differential 112 further includes first and second ring gears 130 and 132. The ring gear 130 is meshed with the gear 114 and is axially aligned with the relief 120 in the gear 116. The ring gear 132 is meshed with the gear 116 and axially aligned with the relief 118 in the gear 114.

The ring gear 132 includes an exterior gear face 134 meshed with a gear 136 on an end of a shaft 140. The shaft 140 drives a fixed displacement hydraulic unit, generally designated 142 of conventional construction and of the general type illustrated in the commonly owned U.S. Pat. No. 3,576,143 issued Apr. 27, 1971 to Baits. The fixed displacement unit 142, when acting as a hydraulic motor, receives hydraulic fluid from a conventional variable displacement hydraulic unit, generally designated 144, which is coaxial with the unit 142 and likewise is of the type described in the previously identified U.S. Patent. A shaft 146 concentric about the shaft 140 drives the variable hydraulic unit 144 and is connected to the differential 112 via a gear 148 meshed with a gear 150 which is mounted with shafts for the gears 114 and 116.

Returning to the ring gear 130, the same acts as an output ring gear for the constant speed drive and is coupled to a hub 154 journaled by bearings 156. An overrunning clutch 158 couples the hub 154 to a shaft 160 splined to the interior of the hub 54. The arrangement is such that during power generation, that is, when after a consideration of the gear ratios involved, the output speed of differential 112 as represented by the speed of the ring gear 130 is greater than the speed of the shaft 160, the rotor 26 will be driven by the overrunning clutch 158, the shaft 160, the gear 52 and the gear 64. Conversely, when the speed of the shaft 160 is greater than that of the output or ring gear 130 of the differential 112, as may occur during use of the device as a starter for the turbine engine 14, the rotor 26 is effectively decoupled from the output of the differential 112 by overrunning of the clutch 158.

As alluded to previously, the differential 112, fixed displacement unit 142 and variable displacement unit 144 define a constant speed drive unit such that for varying speeds of the turbine engine14, the machine 16 when acting as a generator, will be driven at a constant speed to provide an A.C. output of constant frequency. This form of operation is conventional and forms no part of the invention. For details, reference may be had to the previously identified Baits patent, it being sufficient for present purposes to note that the carrier 122 serves as an input to the constant speed drive; that the ring gear 130 serves as an output; and that the other components of the differential 112, and fixed and variable units 142 and 144 serve as control elements.

The system is completed by the provision of one or more sensors shown schematically at 162 in FIG. 1*b*. The sensor 162 may be any suitable and known device capable of, for example converting the output of the PMG 60 to a speed indication and will operate to cause the flow control valve 94 to be opened at some predetermined time during a starting mode when the turbine engine 14 is to be started. When some predetermined speed, representative of a self sustaining speed of the turbine engine 14 is attained, the sensors 162 may cause the control valve 94 to close. Shortly thereafter, the torque converter 70 will be free of hydraulic fluid thereby decoupling the dynamoelectric machine 16 from the shaft 12 via the torque converter 70.

Operation is generally as follows. Electrical power is applied to the windings 20. At this time, the rotor 26 will be stationary and the switch 44 will be closed. As a result, the dynamoelectric machine 16 will function as an A.C. motor and its rotor 26 will begin to rotate. Such rotation will be conveyed to the pump 96 via the gear 64, the gear 52, the hub 54 and the gear teeth 100 and will rapidly bring rotor 26 up to speed.

In short order, the switch 44 will open and the machine 16 will cease operating as a squirrel cage induction motor, operating as an A.C. synchronous motor instead.

At the same time, rotation will be provided to the impeller 80. However, nothing more will occur at this time, the torque converter 70 having drained of hydraulic fluid following its last operation in a starting mode.

At some point, rotor speed 26 will be at a sufficiently high level so that, via the torque converter 70, the turbine engine can be cranked. This is sensed by the sensors 162 which cause the control valve 94 to open. The torque converter will rapidly fill with hydraulic fluid and the rotation of the impeller 80 will be conveyed to the turbine 36.

The rotation of the turbine 86 will be passed via the gear 102 to the gear 104 and via the overrunning clutch 108 to the hub 110 and thus shaft 12 in the turbine engine 14 to crank the same. At this point, because the turbine engine 14 was quiescent, there will be no overrunning of the clutch 108.

Continued operation will bring the turbine engine 14 up to self sustaining speed and once that has occurred, the shaft 12 is free to overrun the gear 104 through action of the overrunning clutch 108.

Generally simultaneously the sensors 162 will determine that occurrence and close the control valve 94 resulting in the starving of the torque converter 70 of hydraulic fluid. Consequently, the rotor 26 will be decoupled from the turbine 86. The provision of electrical power to the stator windings 20 is also terminated at this time.

At the same time, rotational power from the now operational turbine engine 14 will be conveyed to the differential 112 and inputted thereto via the carrier 122. The differential 112 and the hydraulic units 142 and 144 will function conventionally to provide a constant speed output at the ring gear 130. At this point in the sequence, the speed of the rotor 26 may typically be somewhat below the controlled output speed of the ring gear 130 with the consequence that rotor 26 will be driven by the overrunning clutch 158, the shaft 160, and the gears 52 and 64. This will rapidly bring the rotor 26 up to the desired speed and in the process the centrifugal switch 44 will open if it has not remained open following its opening during the start mode. Consequently, the rotor 26 will now be conventionally electrically configured as a brushless synchronous generator and power generation will occur.

From the foregoing it will be seen that a starter-generator made according to the invention provides optimal efficiency of operation. A brushless generator can be used to develop sufficient torque to crank a turbine engine by means of the use of the torque converter 70 which further acts as a means whereby components used during engine starting can be decoupled from the system when the dynamoelectric machine is being operated as a generator.

We claim:

1. A starter-generator for an engine comprising:

a dynamoelectric machine alternatively operable as a motor or as a generator and having a rotor;

a hydraulic torque converter including a housing containing an impeller and a turbine, said impeller being connected to said rotor to be driven thereby when said dynamoelectric machine is operated as a motor.

means for selectively filling said housing with hydraulic fluid to couple said impeller and said turbine;

a controlled speed drive unit having an input adapted to be connected to an engine, an output adapted to be connected to said rotor and control means interconnecting the input and the output to provide a desired speed relation between the two;

a first overrunning clutch interconnecting said turbine and said input for allowing said input to overrun said turbine but not the reverse; and a second overrunning clutch interconnecting said rotor and said output for allowing said rotor to overrun said output but not the reverse;

whereby an engine (a) may be started by said dynamoelectric machine when operated as a motor via a power train including said torque converter and said first overrunning clutch and (b) may drive the dynamoelectric machine as a generator and at desired speeds via a second power train including said controlled speed drive unit and said second overrunning clutch.

2. The starter generator of claim 1 wherein said torque converter and said rotor are coaxial.

3. The starter generator of claim 1 wherein said selective filling means comprises an inlet to said housing, a pump connected to said housing inlet and a means for controlling the flow from said pump to said inlet.

4. The starter generator of claim 3 wherein said flow controlling means comprises a valve interposed between said pump and said housing.

5. The starter generator of claim 4 wherein said housing has an open outlet, said pump being sized to deliver more hydraulic fluid to said inlet than can escape the housing through said open outlet in the same period of time.

6. A starter-generator for an engine comprising;

a brushless generator alternatively operable as an A.C. motor and having a rotor including a rectifier;

a hydraulic torque converter including a housing containing a stator, an impeller and a turbine, said impeller being connected to said rotor to be driven thereby when said generator is operated as a motor.

means for selectively filling said housing with hydraulic fluid to couple said impeller and said turbine;

a controlled speed drive unit having an input adapted to be connected to an engine, an output adapted to be connected to said rotor and control means interconnecting the input and the output to provide a desired speed relation between the two;

a speed responsive switch for shunting said rectifier at rotor speeds less than a desired level;

a first coupling interconnecting said turbine and said input and operable to permit said input to run faster than said turbine but not the reverse;

a first coupling interconnecting said turbine and said input for allowing said input to overrun said turbine but not the reverse;

a second coupling interconnecting said rotor and said output and operable to permit said rotor to run faster than said output but not the reverse;

whereby an engine (a) may be started by said generator when operated as a motor via a power train including said torque conveyor and said first coupling and (b) may drive the generator at a desired speed via a second power train including said controlled speed drive unit, said impeller and said turbine.

7. The starter-generator of claim 6 wherein at least one of said couplings is a clutch.

8. The starter-generator of claim 7 wherein said clutch is an overrunning clutch.

9. A starter-generator for a turbine engine comprising:

a brushless generator alternatively operable as a A.C. motor and having a rotor including a field a hydraulic torque converter including a housing containing a stator, an impeller and a turbine, said impeller being connected to said rotor to be driven thereby when said generator is operated as a motor, said housing further including an inlet and an open outlet for hydraulic fluid;

means including a valve for selectively filling said housing with hydraulic fluid to couple said impeller and said turbine; said housing emptying through said open outlet when said filling means is not utilized;

a constant speed drive unit having an input adapted to be connected to a turbine engine, an output adapted to be connected to said rotor and control means interconnecting the input and the output to provide a constant speed at said output for varying input speeds;

a speed responsive switch carried by said rotor for shunting said field at rotor speeds less than a predetermined value;

a first overrunning clutch interconnecting said turbine and said input for allowing said input to overrun said turbine but not the reverse; and a second overrunning clutch interconnecting said rotor and said output for allowing said rotor to overrun said output but not the reverse;

whereby a turbine engine (a) may be started by said generator when operated as a motor via a power train including said torque converter and said first overrunning clutch and (b) may drive the generator and at constant speeds via a second power train including said controlled speed drive unit and said second overrunning clutch.

10. A starter-generator for a turbine engine comprising:

a dynamoelectric machine alternatively operable as a motor or as a generator and having a rotor;

a hydraulic torque converter including a housing containing an impeller and a turbine, said impeller being connected to said rotor to be driven thereby when said dynamoelectric machine is operated as a motor;

means for selectively filling said housing with hydraulic fluid to couple said impeller and said turbine;

a controlled speed drive unit having an input adapted to be connected to a turbine engine, an output adapted to be connected to said rotor and control means interconnecting the input and the output to provide a desired speed relation between the two;

a first coupling interconnecting said turbine and said input and operable to disconnect said input from said turbine for input speeds greater than the speed of said turbine;

a second coupling interconnecting said rotor and said output and operable to disconnect said rotor from said output for rotor speeds greater than the speed of said output whereby a turbine engine (a) may be started by said dynamoelectric machine when operated as a motor via a power train including said torque converter and said first coupling and (b) may drive the dynamoelectric machine as a generator and at desired speeds via a second power train including said controlled speed drive unit and said coupling.

11. The starter-generator of claim 10 wherein each said coupling comprises a clutch.

* * * * *